US007708359B2

(12) United States Patent
Peng et al.

(10) Patent No.: US 7,708,359 B2
(45) Date of Patent: May 4, 2010

(54) LATCH MECHANISM FOR SLIDE RAIL ASSEMBLY

(75) Inventors: Wen-Tang Peng, Taipei Hsien (TW); Mo-Ming Yu, Shenzhen (CN); Zong-Yuan Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 405 days.

(21) Appl. No.: 11/738,526

(22) Filed: Apr. 23, 2007

(65) Prior Publication Data

US 2008/0034662 A1 Feb. 14, 2008

(30) Foreign Application Priority Data

Jun. 2, 2006 (CN) ..... 2006 1 0060950

(51) Int. Cl.
*A47B 88/04* (2006.01)

(52) U.S. Cl. ..... 312/334.47; 312/334.44

(58) Field of Classification Search ..... 312/319.1, 312/330.1, 334.1, 334.7, 334.8, 333, 334.44, 312/334.46, 334.47; 384/18, 21, 22
See application file for complete search history.

(56) References Cited

U.S. PATENT DOCUMENTS

| | | | | |
|---|---|---|---|---|
| 3,462,203 | A * | 8/1969 | Vecchio | 384/19 |
| 6,367,899 | B1 * | 4/2002 | Hwang et al. | 312/334.47 |
| 6,412,891 | B1 * | 7/2002 | Liang et al. | 312/334.44 |
| 6,945,619 | B1 * | 9/2005 | Chen et al. | 312/334.47 |
| 2003/0080659 | A1 * | 5/2003 | Judge et al. | 312/334.47 |
| 2004/0174104 | A1 * | 9/2004 | Chen et al. | 312/334.47 |

* cited by examiner

*Primary Examiner*—James O Hansen
(74) *Attorney, Agent, or Firm*—Wei Te Chung

(57) ABSTRACT

A latch mechanism is provided for retaining a slide rail assembly, which includes first and second slide rails. The latch mechanism includes a latch member movably attached to the second slide rail, a stop member mounted to the first slide rail to engage in the latch member for retaining the second slide rail relative to the first slide rail, and a release member slidably attached to the second slide rail. The latch member includes first and second driven portion at one side thereof, and a cutout. The cutout has a first and second stop surfaces at opposite ends thereof. The release member is capable of pushing the first or second driven portion to release the first or second stop surface from the stop member. A resilient member is placed between the latch member and the second slide rail for returning the latch member to an original position.

18 Claims, 9 Drawing Sheets

LATCH MECHANISM FOR SLIDE RAIL ASSEMBLY

BACKGROUND OF THE INVENTION

1. Field of the Invention

The present invention relates to a latch mechanism for a slide rail assembly.

2. Description of Related Art

Slide rails are used in a variety of applications, including business furniture, kitchen drawers, electronic racks, and copiers. One type of slide rail is a telescopic slide rail. Telescopic slide rails often comprise two, three, four or more telescoping members. The shape of a slide rail, and the individual members, are determined by the design. The slides can be frictional, with lubricated members rubbing against each other, or a slide assembly may include roller or ball bearings for easier movement. The members in such assemblies tend to be C-shaped in nature.

A conventional three-section slide rail assembly for a drawer includes a first slide rail (e.g. outer slide rail), a second slide rail (e.g. middle slide rail), and a third slide rail (e.g. inner slide rail). A ball rail is sandwiched between any two of the first slide rail, the second slide rail, and the third slide rail to provide a smooth sliding movement. Moreover, the third slide rail and the second slide rail mount a retaining member and a stop member respectively to prevent the slide rails extending too far. The retaining member is attached to an inner surface of the third slide rail, and provided with an inclined wall. The stop member is mounted to a front end of the second slide rail, and provided with a protrusion. To prevent users from drawing the third slide rail out too far from the second slide rail, the protrusion of the stop member engages with the inclined wall of the retaining member.

Users can draw out a keyboard or a component, which is attached to the third slide rail, for servicing. Although the engagement of the stop member with the inclined wall avoids the release of the third slide rail from the second slide rail by accident, it cannot prevent the third slide rail retracting into the second slide rail too far by careless force of users. Therefore, it is inconvenient to users for operating the slide rail assembly in use.

Consequently, it is required to provide a two-way latch mechanism for a slide rail assembly.

SUMMARY OF THE INVENTION

In one preferred embodiment, a latch mechanism is provided for retaining a slide rail assembly, which includes first and second slide rails. The latch mechanism includes a latch member movably attached to the second slide rail, a stop member mounted to the first slide rail to engage in the latch member for retaining the second slide rail relative to the first slide rail, and a release member slidably attached to the second slide rail. The latch member includes first and second driven portion at one side thereof, and a cutout. The cutout has a first and second stop surfaces at opposite ends thereof. The release member is capable of pushing the first or second driven portion to release the first or second stop surface from the stop member. A resilient member is placed between the latch member and the second slide rail for returning the latch member to an original position.

Other advantages and novel features of the present invention will become more apparent from the following detailed description of preferred embodiment when taken in conjunction with the accompanying drawings, in which:

DETAILED DESCRIPTION OF THE INVENTION

Figure 1:
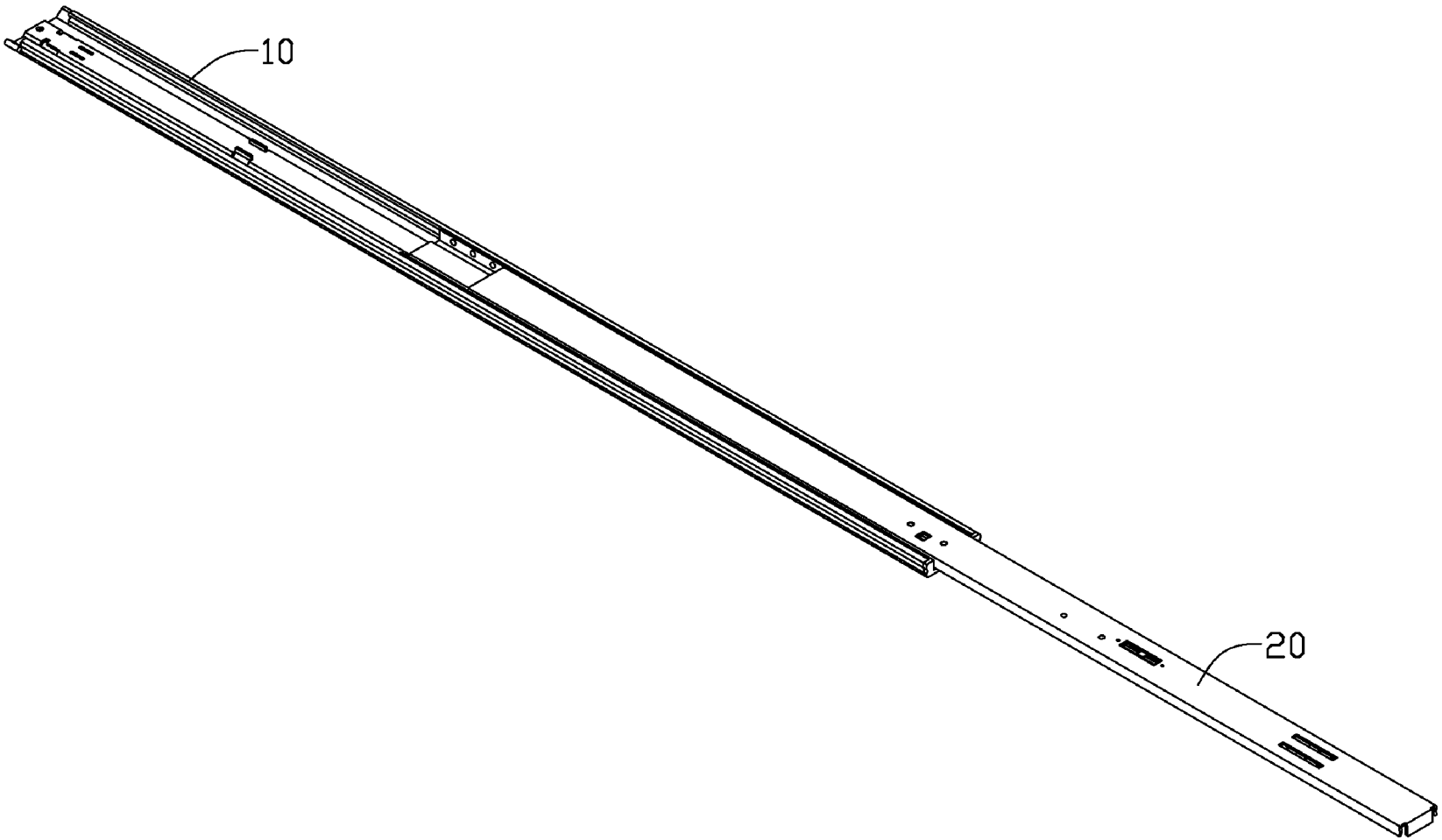
FIG. 1 is an assembled view of a slide rail assembly according to a preferred embodiment of the present invention.
Figure 2:
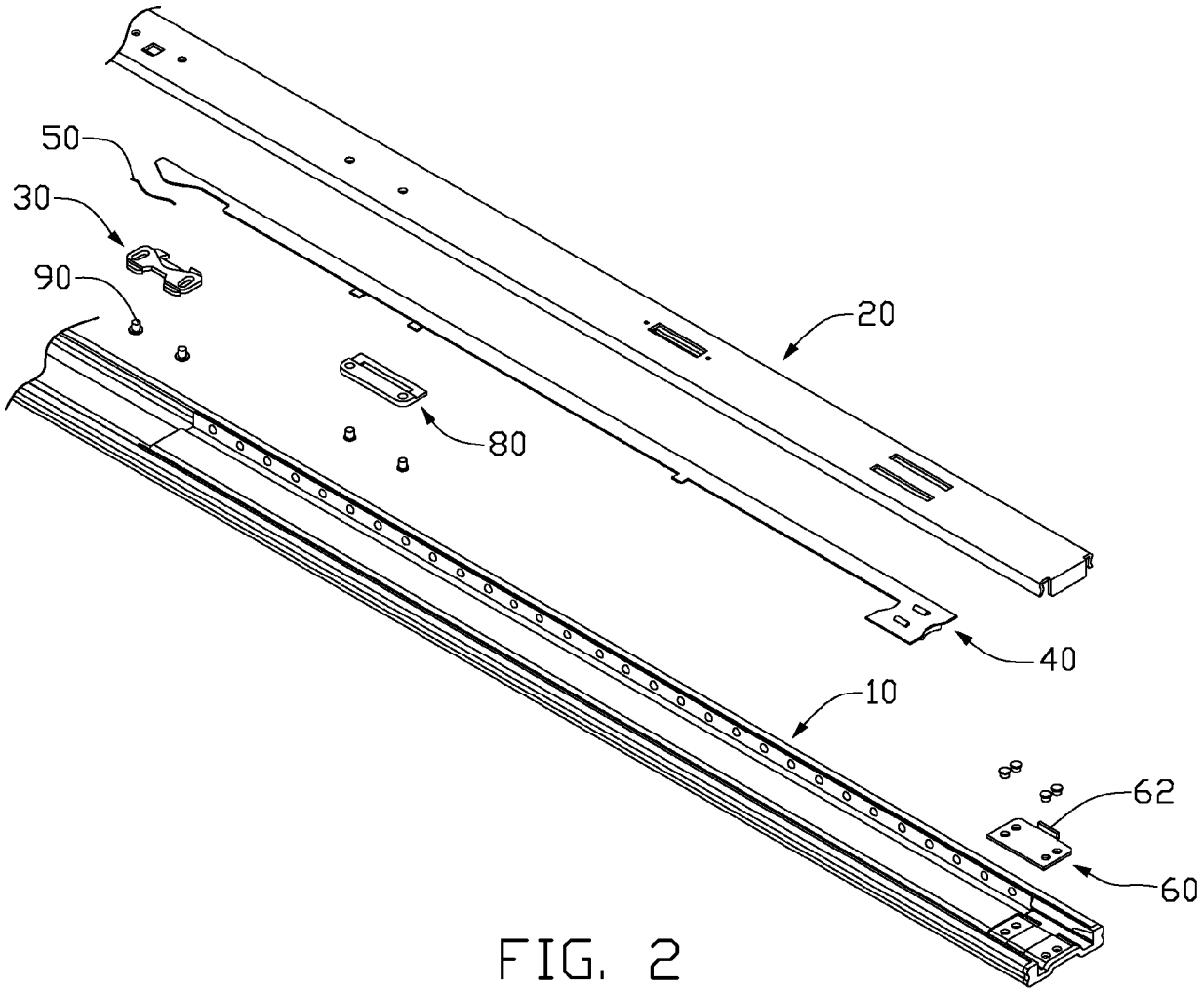
FIG. 2 is an exploded, isometric view of FIG. 1.

Referring to FIGS. 1 and 2, in a preferred embodiment of the invention, a latch mechanism is provided for retaining a slide rail assembly which includes a first slide rail 10, and a second slide rail 20. The latch mechanism includes a latch member 30, a release member 40, a resilient member 50, a stop member 60 mounted on the first slide rail 10, a mounting member 80, and two posts 90.

Figure 3:
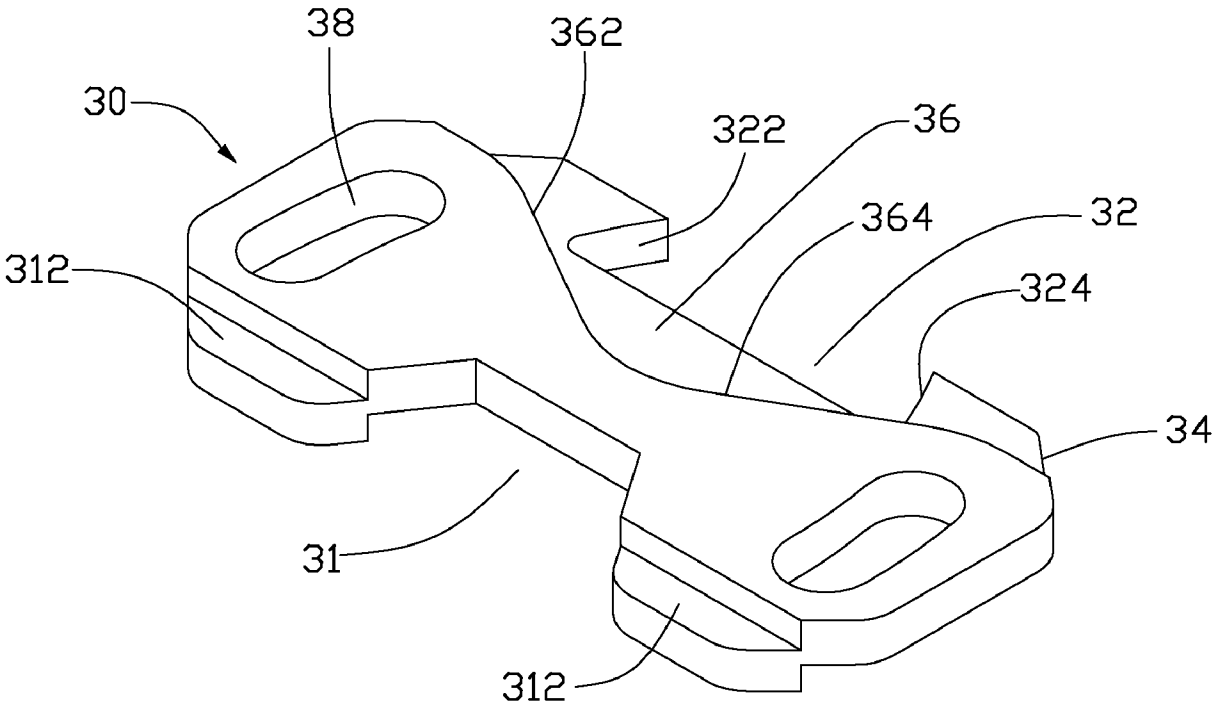
FIG. 3 is an enlarged view of a latch member of the slide rail assembly of FIG. 2.
Figure 4:
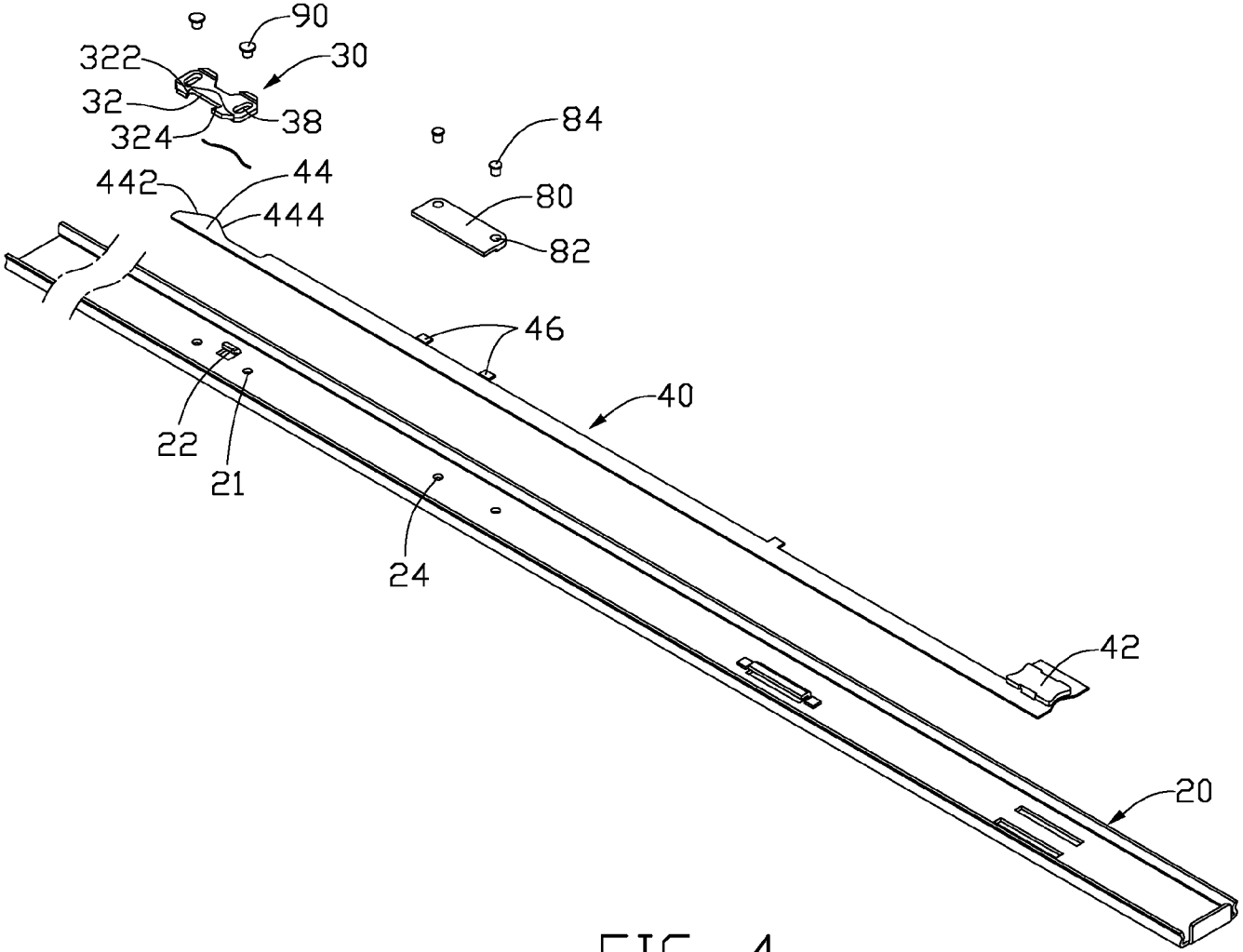
FIG. 4 is an inverted view of part of FIG. 2.

Referring to FIGS. 3 and 4, the second slide rail 20 defines two mounting holes 21 therein at a predetermined retaining position of the second slide rail 20 and the first slide rail 10. A bent tab 22 is formed on the second slide rail 20 between the two mounting holes 21. Two through holes 24 are defined in the second slide rail 20 in the vicinity of the mounting holes 21.

The latch member 30 has two opposite sides, wherein one side comprises two stepped portions 312, and a space 31 between the stepped portions 312, and wherein the other side is stepped and comprises two inclined portions 34 at opposite ends thereof, a cutout 32 between the two inclined portions 34, and a recess portion 36 that is generally V-shaped and has a first driven portion 362 and a second driven portion 364. The cutout 32 has a first and a second stop surface 322, 324 formed from two sidewalls thereof respectively. Two arc-shaped slots 38 are defined in opposite ends of the latch member 30.

The release member 40 is elongated, and includes an operating portion 42 arranged at one end thereof, a cam 44 formed from an opposite end thereof, and a plurality of tabs 46 extending from a middle portion thereof. The cam 44 is V-shaped, and forms a first driving portion 442 and a second driving portion 444 at two sides thereof respectively.

The resilient member 50 is generally V-shaped, and preferably made by bending a resilient steel wire. The stop member 60 includes a protrusion 62 bent from a side thereof.

The mounting member 80 is generally rectangular and includes a stepped side surface. Two mounting holes 82 are defined in the mounting member 80.

Figure 5:
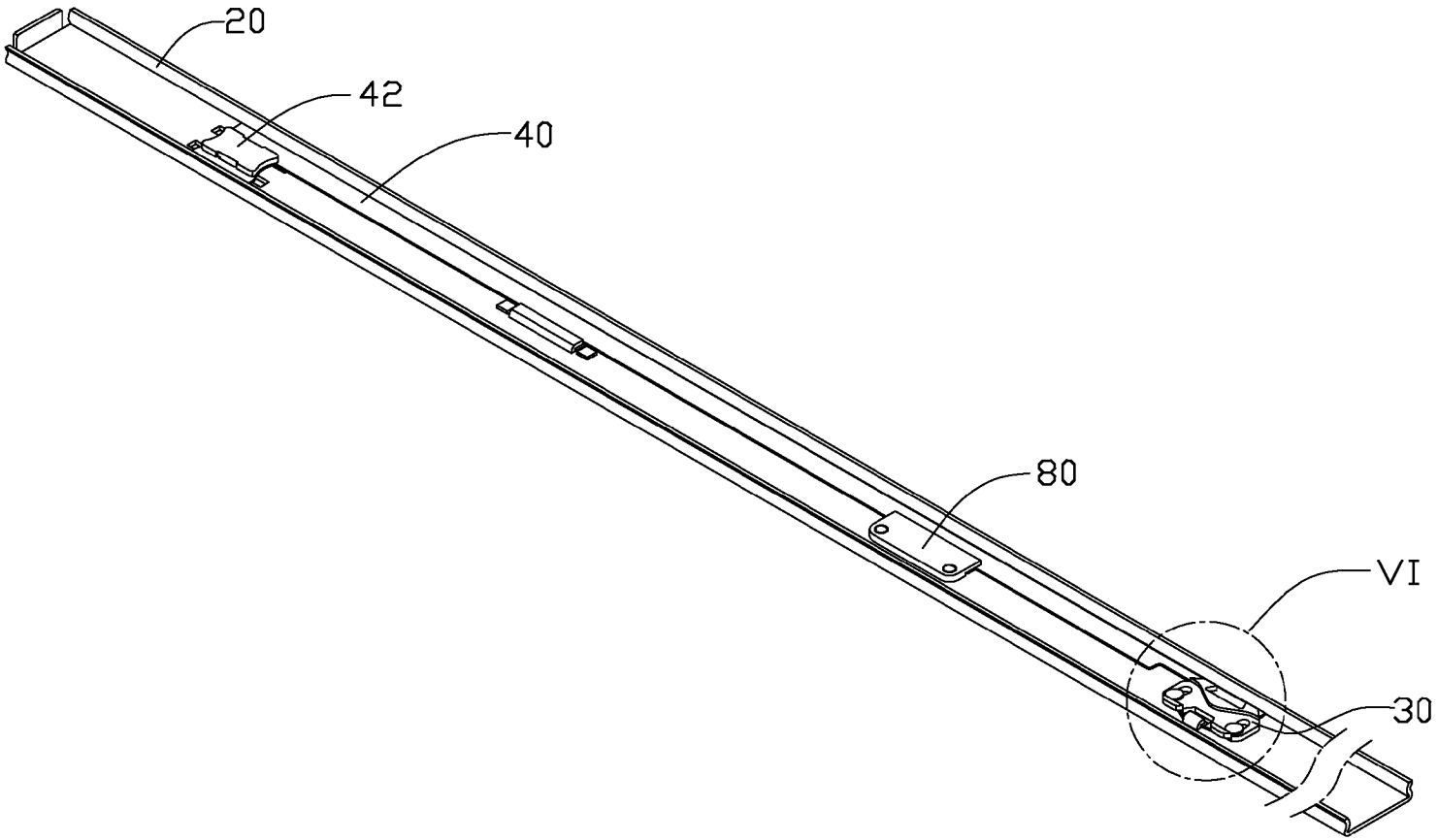
FIG. 5 is an assembled view of FIG. 4.
Figure 6:
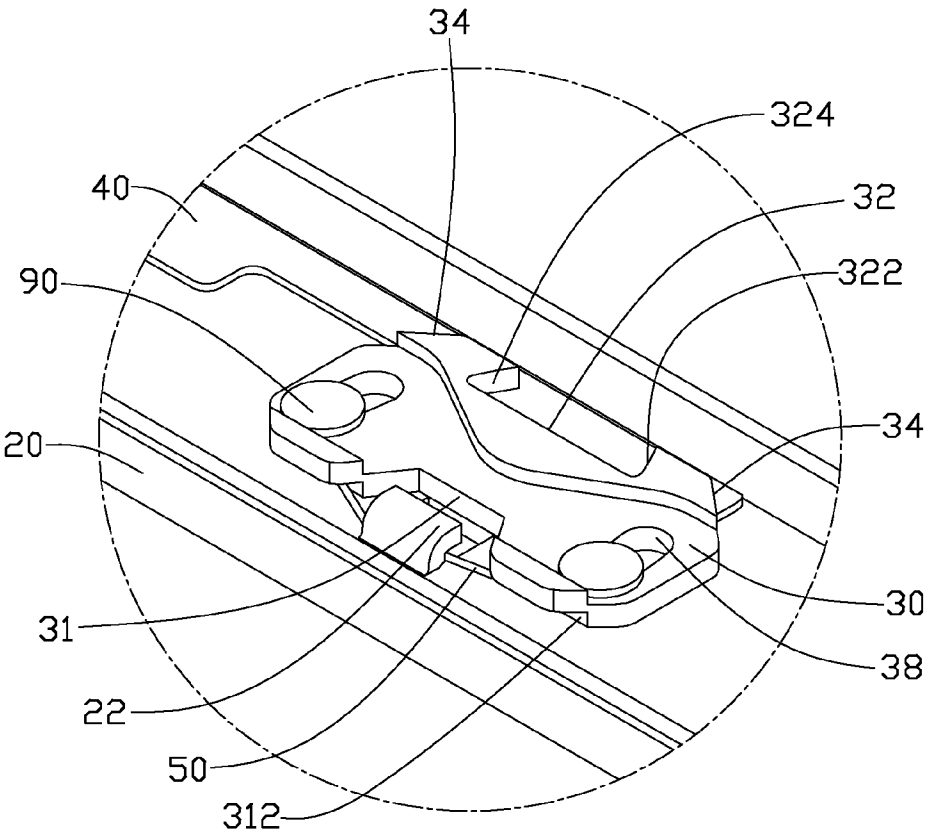
FIG. 6 is an enlarged view of a circled portion VI of FIG. 5.

Referring also to FIGS. 5 and 6, in assembly, the release member 40 is attached to the second slide rail 20. The mounting member 80 is mounted on the second slide rail 20 by two screws 84 extending through the mounting holes 82 of the mounting member 80 to engage in the through holes 24 of the second slide rail 20 respectively. The tabs 46 of the release member 40 are located under the mounting member 80. The latch member 30 is attached to the second slide rail 20. The cam 44 of the release member 40 is received in the recess portion 36 of the latch member 30. A middle portion of the resilient member 50 is held under the bent tab 22 of the second slide rail 20, and two distal ends of the resilient member 50 engage with the stepped portions 312 of the latch member 30 respectively. Two posts 90 extend through the slots 38 of the latch member 30 to be screwed into the mounting holes 21 of the second slide rail 20 respectively, thus the latch member 30 is movably mounted to the second slide rail 20. The stop member 60 is mounted to one end of the first slide rail 10 opposing the latch member 30.

Figure 7:
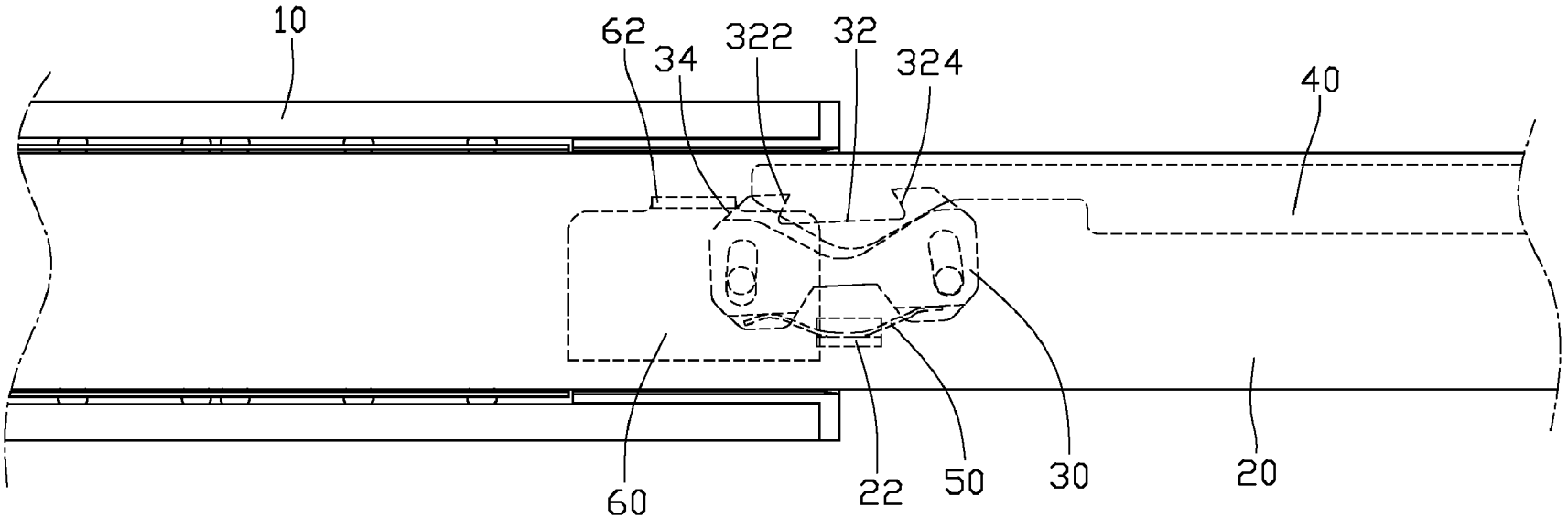
FIGS. 7-9 are lateral views of the slide rail assembly of FIG. 1 in three using states.

Referring also to FIG. 7, when pushing the second slide rail 20 to slide into the first slide rail 10, the leading inclined portion 34 of the latch member 30 rides over the protrusion 62 of the stop member 60, thereby biasing the latch member 30 counter-clockwise against the resilient member 50 until the protrusion 62 of the stop member 60 slides into the cutout 32 of the latch member 30.

Figure 8:
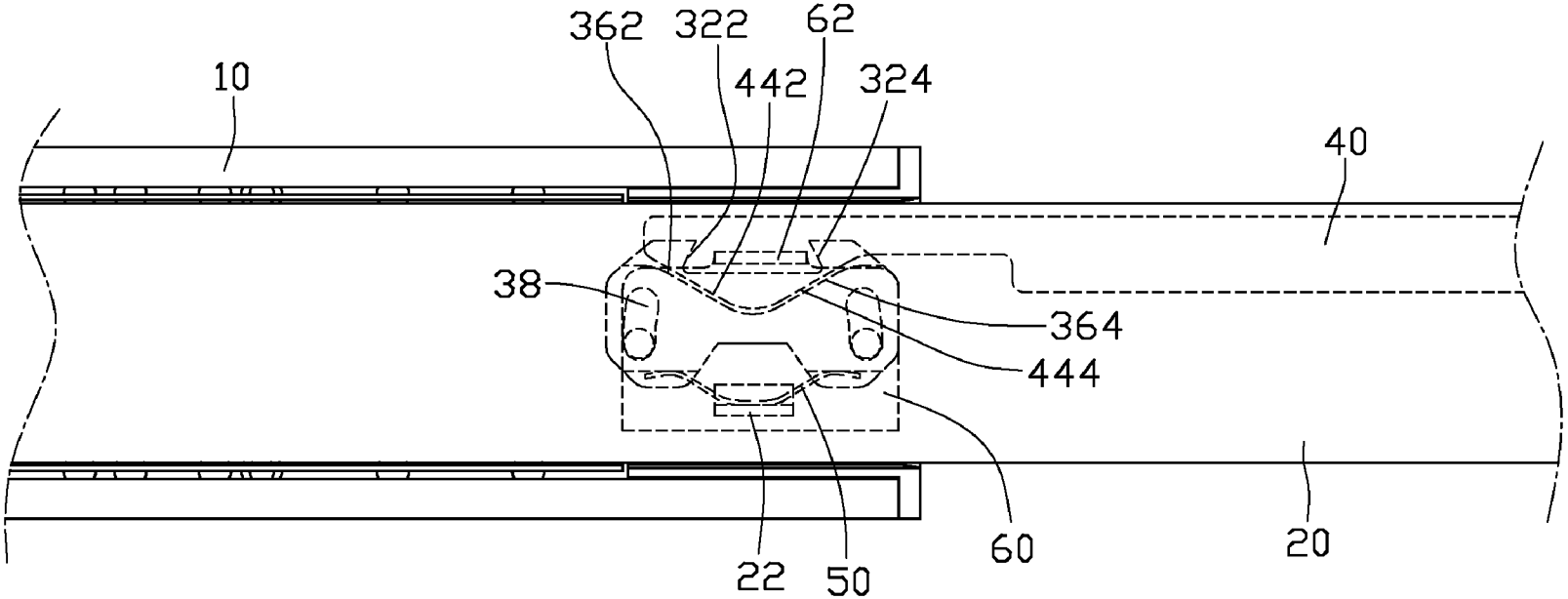

Referring also to FIG. 8, after the protrusion 62 of the stop member 60 enter into the cutout 32 of the latch member 30, the resilient member 50 rebounds to return the latch member 30 to its original position, thus the protrusion 62 of the stop member 60 is locked in the cutout 32 of the latch member 30. Therefore, the protrusion 62 of the stop member 60 is confined by the first stop surface 322 or the second stop surface 324 of the cutout 32 of the latch member 30 to avoid the second slide rail 20 moving outward or inward relative to the first slide rail 10.

Figure 9:
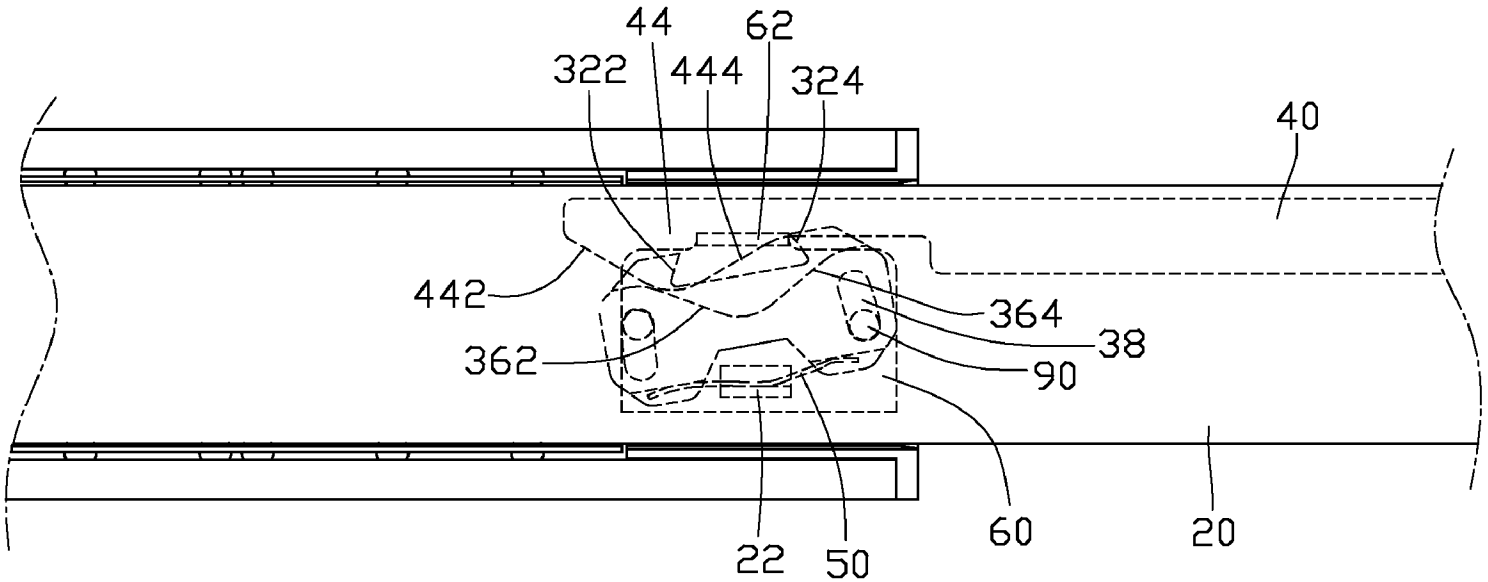

Referring also to FIG. 9, in releasing the second slide rail 20 from the first slide rail 10, push the operating portion 42 of the release member 40 inward along the second slide rail 20. The first driving portion 442 of the cam 44 engages with the first driven portion 362 of the latch member 30 to bias the latch member 30 counter-clockwise. The first stop surface 322 of the latch member 30 disengages from the protrusion 62 of the stop member 60 which allows the second slide rail 20 outward without allowing inward movement relative to the first slide rail 10. The same principle applies when pushing the release member 40 outward along the second slide rail 20. The second driving portion 444 of the cam 44 pushes the second driven portion 364 of the latch member 30 to bias the latch member 30 clockwise. The second stop surface 324 of the latch member 30 disengages from the protrusion 62 of the stop member 60 which allows the second slide rail 20 inward without allowing outward movement relative to the first slide rail 10.

When the latch member 30 leaves the protrusion 62 of the stop member 60, releasing the operating portion 42 of the release member 40, the resilient member 50 rebounds to return the latch member 30 to its original position. The first driven portion 362 or the second driven portion 364 of the latch member 30 drives the cam 44 of the release member 40 to return the release member 40 to its original position.

The protrusion 62 may extend from the first slide rail 10 directly. A spring can be placed between the release member 40 and the second slide rail 20 for returning the release member 40 to its original position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A latch mechanism for retaining a slide rail assembly which comprises a first slide rail and a second slide rail, comprising:

an integrative latch member movably attached to the second slide rail, the latch member comprising a first driven portion and a second driven portion at one side thereof, and a cutout, a first stop surface and a second stop surface formed at opposite ends of the cutout;

a stop member arranged on the first slide rail to engage in the cutout of the latch member for retaining the second slide rail relative to the first slide rail;

a release member slidably attached to the second slide rail, the release member capable of selectively pushing the first driven portion to release the first stop surface from the stop member to allow the second slide rail to move in one way relative to the first slide rail, or pushing the second driven portion to release the second stop surface from the stop member to allow the second slide rail to move in another way opposite to the one way; and a resilient member placed between the latch member and the second slide rail for returning the latch member to an original position.

2. The latch mechanism as described in claim 1, wherein the latch member defines two arc-shaped slots, two posts respectively extend through the slots of the latch member to movably attach the latch member to the second slide rail, the two slots are arranged in such a way that the latch member is capable of being biased counter-clockwise relative to the second slide rail around one of the posts, or being biased clockwise relative to the second slide rail around the other one of the posts.

3. The latch mechanism as described in claim 1, wherein the latch member defines a V-shaped recess portion, the first driven portion and the second driven portion are formed at two sides of the recess portion respectively, the cutout and the stop surfaces being located above the recess portion in a direction perpendicular to a sliding direction of the release member.

4. The latch mechanism as described in claim 3, wherein a V-shaped cam extends from one end of the release member and is received in the recess portion of the latch member.

5. The latch mechanism as described in claim 4, wherein a first driving portion and a second driving portion are formed at two sides of the cam of the release member respectively configured for pushing the first and second driven portions respectively.

6. The latch mechanism as described in claim 1, further comprising a mounting member configured for slidably attaching the release member to the second slide rail.

7. The latch mechanism as described in claim 1, wherein two inclined portions are formed at two opposite ends of the latch member respectively for guiding the stop member to the cutout of the latch.

8. The latch mechanism as described in claim 1, wherein two stepped portions are formed from another side of the latch member with a space formed therebetween, a bent tab extends up from the second slide rail to be received in the space, a middle portion of the resilient member is held under the bent tab, and two ends of the resilient member engage with the two stepped portions respectively.

9. The latch mechanism as described in claim 1, wherein the stop member forms a protrusion for engaging in the cutout of the latch member.

10. A slide rail assembly comprising:

a first slide rail having a protrusion arranged thereon;

a second slide rail;

an integrative latch member being attached to the second slide rail and movable around two posts that are perpendicular to the second slide rail, the latch member comprising two inclined portions at opposite sides of the latch member respectively, and a cutout defined between the inclined portions, wherein the protrusion of the first slide rail rides over either one of the inclined portions to be restrained in the cutout when the second slide rail slides relative to the first slide rail;

a release member slidable relative to the second slide rail; and a resilient member connected to the latch member for returning the latch member to an original position;

wherein the release member is capable of being slid inward relative to the second slide rail to move the latch member to release the protrusion from the cutout thereby allowing the second slide rail being slid outward relative to the first slide rail, and the release member is capable of being slid outward relative to the second slide rail to move the latch member to release the protrusion from the cutout thereby allowing the second slide rail being slid inward relative to the first slide rail.

11. The slide rail assembly as described in claim 10, wherein two arc-shaped slots are defined in opposite ends of the latch member, two posts respectively extend through the slots of the latch member to movably attach the latch member to the second slide rail, the two slots are arranged in such a way that the latch member is capable of being biased counter-clockwise relative to the second slide rail around one of the posts, or being biased clockwise relative to the second slide rail around the other one of the posts.

12. A slide rail assembly comprising:

a first slide rail having a protrusion provided thereat;

a second slide rail slidably mounted to the first slide rail;

a latch member comprising a pair of inclined driven portions, a pair of slots through which a pair of posts respectively extends to thereby movably attach the latch member to the second slide rail, and a cutout configured for retaining the protrusion thereat; and a release member slidably attached to the second slide rail, the release member comprising a pair of inclined driving portions corresponding to the driven portions of the latch member, wherein the release member is capable of sliding in one direction relative to the second slide rail to cause one of the driving portions to move one corresponding driven portion in the one direction which results in the latch member rotating about one of the posts and thereby releasing the protrusion from the cutout in another direction opposing to the one direction, and the release member is capable of sliding in the another direction relative to the second slide rail to cause the other one of the driving portions to move the other one corresponding driven portion in the another direction which results in the latch member rotating about the other one of the posts and thereby releasing the protrusion from the cutout in the one direction.

13. The slide rail assembly as claimed in claim 12, wherein the release member is located between the second slide rail and the first slide rail, and the protrusion is located between the first slide rail and the release member.

14. The slide rail assembly as claimed in claim 12, further comprising a resilient member configured for returning the latch member back to its original position.

15. The slide rail assembly as claimed in claim 14, wherein the latch member comprises a pair of stop surfaces formed at opposite sides of the cutout configured for retaining the protrusion therebetween to prevent the second slide rail from sliding relative to the first slide rail.

16. The slide rail assembly as claimed in claim 12, wherein the latch member defines a V-shaped recess portion, the pair of driven portions is formed at two sides of the recess portion respectively, the cutout being located above the recess portion in a direction perpendicular to a sliding direction of the release member.

17. The slide rail assembly as claimed in claim 16, wherein a V-shaped cam extends from one end of the release member and is received in the recess portion of the latch member.

18. The slide rail assembly as claimed in claim 17, wherein a first driving portion and a second driving portion are formed at two sides of the cam of the release member respectively configured for pushing the pair of driven portions of the latch member respectively.

* * * * *